United States Patent [19]

Lane

[11] 4,081,185

[45] Mar. 28, 1978

[54] OIL WELL SWAB CUP

[75] Inventor: John Jay Lane, Dallas, Tex.

[73] Assignee: Dresser Industries, Inc., Dallas, Tex.

[21] Appl. No.: 708,238

[22] Filed: Jul. 23, 1976

[51] Int. Cl.[2] ..... F16J 15/32

[52] U.S. Cl. ..... 277/212 C; 277/235 R; 92/241; 92/254

[58] Field of Search ..... 277/235 R, 212 C, 212 R, 277/179, 189; 92/241, 254; 166/173, 176

[56] References Cited

U.S. PATENT DOCUMENTS

| | | | |
|---|---|---|---|
| 1,601,720 | 10/1926 | Christenson | 92/241 |
| 2,305,282 | 12/1942 | Taylor et al. | 277/235 X |
| 2,352,812 | 7/1944 | Taylor | 92/241 |
| 2,438,992 | 4/1948 | Childers | 277/212 X |
| 2,619,393 | 11/1952 | Wilson et al. | 92/241 |
| 2,723,721 | 11/1955 | Corsette | 277/212 C X |
| 2,887,347 | 5/1959 | Losey | 92/241 |
| 3,081,136 | 3/1963 | Waldrop | 92/241 |
| 3,417,673 | 12/1968 | Bowerman | 277/212 C X |
| 3,450,412 | 6/1969 | Collett | 277/212 |
| 3,722,053 | 3/1973 | Berry et al. | 92/241 X |

*Primary Examiner*—Robert S. Ward, Jr.
*Attorney, Agent, or Firm*—Michael J. Caddell; Roy L. Van Winkle

[57] ABSTRACT

An oil well swab cup with improved wear characteristics utilizes a single integral reinforcing structure featuring a wear surface forming a substantial portion of the external surface of the cup.

13 Claims, 7 Drawing Figures

OIL WELL SWAB CUP

BACKGROUND OF THE INVENTION

The present invention is directed to an oil well swab cup for use on a swabbing mandrel and removing fluids from an oil well. More specifically, the present invention involves a swab cup of the design wherein an elastomeric sealing element is bonded to a metallic reinforcing structure. The prior art devices are directed to the structures for swab cups, wherein the elastomeric material is bonded to the outside and usually on the inside of the reinforcing cage.

The difficulties incurred in the prior art devices include rapid deterioration and wear of the elastomeric material along the outer surfaces of the prior art devices. The present invention overcomes these disadvantageous by utilizing a reinforcing structure which forms a major portion of the outer surface of the swab cup, which reinforcing structure may be formed from a relatively hard metal providing far greater wear resistance for the apparatus. The present invention provides a sturdy long wearing swab cup which is easy to manufacture.

DESCRIPTION OF THE PREFERRED EMBODIMENTS

Figure 1:
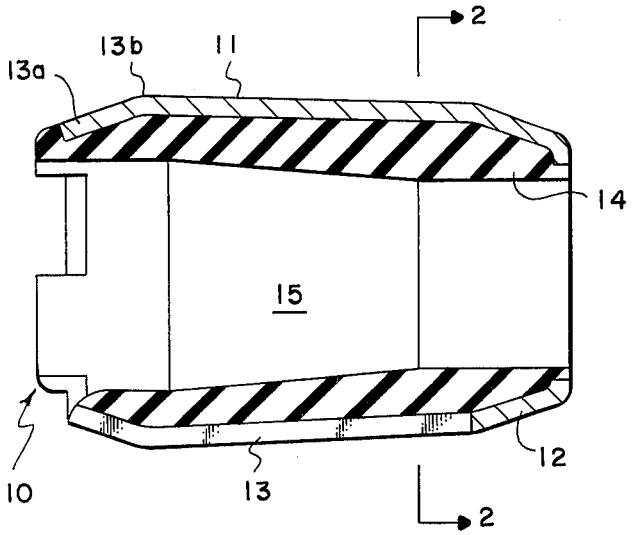
FIG. 1 is a lateral cross-sectional side view of one embodiment of the invention.

FIG. 1 illustrates a swab cup 10 having an outer metallic reinforcing structure 11. Structure 11 comprises a circular base 12 from which extend a plurality of upward extending reinforcement arms 13. An elastomeric sealing material 14 is attached to the inner surface of structure 11 by means such as bonding or cementing.

A bore passage 15 is located through the center of the elastomeric element 14 and element 14 is arranged to sealingly engage the swab mandrel shoulder on the rod string upon which the swab cup is placed. The arms 13 are located a spaced distance apart and define a series of longitudinal slots therebetween, which slots are filled by the elastomeric material 14 to provide additional sealing against the tubing or casing wall in which the swab cup is being used.

The reinforcing structure 11 features an inwardly tapered base 12 with outwardly tapered arms 13 extending upward therefrom. At the upper extremity of arms 13 is an inward flexed lead-on area **13*a*, and an annular sealing lip 13*b*** which provides a full circle seal against the inner wall of the tubing or casing. The lead-on area is provided to prevent hang-up of the swab cup in collars.

Figure 2A:
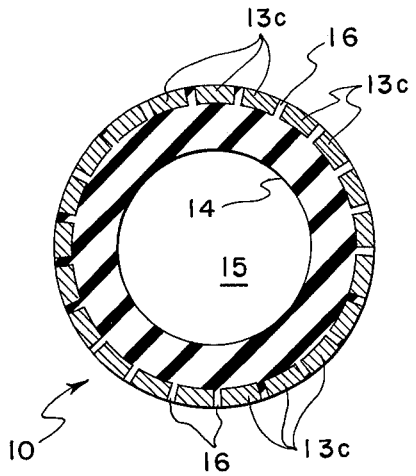
FIG. 2A is an axial cross-sectional view taken at line 2—2 of FIG. 1 and illustrating one type of reinforcing structure utilized.
Figure 2B:
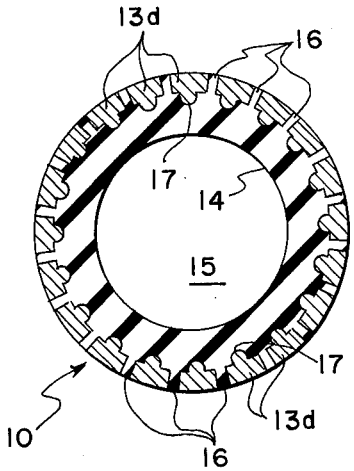
FIG. 2B is an axial cross-sectional view illustrating a second embodiment of the reinforcing structure used in FIG. 1.

Referring to FIGS. 2A and 2B, two different types of construction of arms 13 are illustrated. FIG. 2A, a plurality of segmental-arc support arms **13*c* are shown having a curvilinear cross-sectional configuration. Each supporting arm 13*c* is separated from the other arms by a longitudinal gap 16, which is preferably filled with elastomeric material. In FIG. 2B, a different configuration for the support arms is illustrated at 13*d*. These reinforcement arms are provided with an inner reinforcing rib 17** formed along the inner curved surface of the arm.

This results in a generally T-shaped cross-sectional configuration which provides for extended life of the swab cup by providing a continuous reinforcement even after most of the curved outer portion has worn away. The relatively thinner arms **13*c* will wear out faster than the T-shaped arms of 13*d*** but offer the advantage of better flexibility, whereas the T-shaped arms will wear longer and sustain heavier loading.

Figure 3:
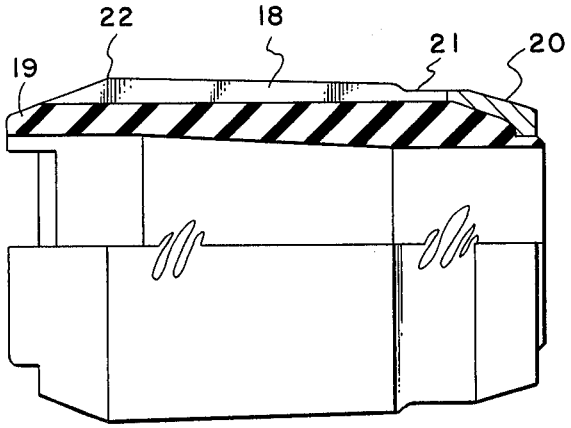
FIG. 3 is a partial lateral cross-section showing another embodiment of the invention.

FIG. 3 illustrates another embodiment of the invention utilizing a lower integral base section 20 and upward extending reinforcement arms 18 having axial longitudinal spaces therebetween. An elastomeric sealing element 19 is bonded or cemented to the inside of the reinforcing structure and protrudes radially outward filling the spaces between the reinforcing arms 18.

The reinforcing structure utilizes a narrowed flex section 21 and a thicker wear section from section 21 to the sealing lip 22. Thus, the embodiment of FIG. 3 combines the longer wear life of arms **13*d* with the greater flexibility of arms 13*c*** into one swab cup structure.

Figure 4:
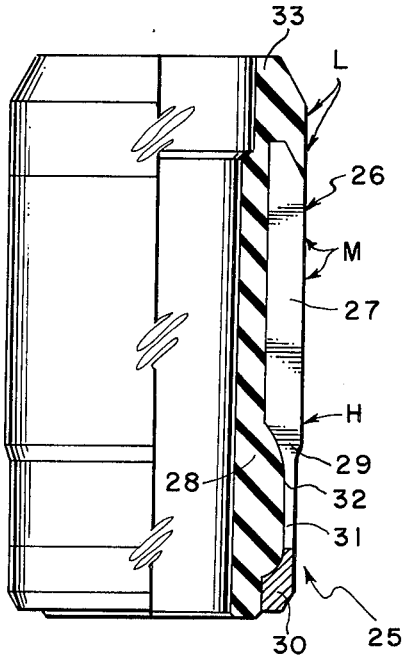
FIGS. 4, 5, and 6 illustrate partial cross-sectional side views of three additional embodiments of the invention.

In FIG. 4, a reinforced cup structure 25 is illustrated having two cylindrical exterior surfaces 26 and 31 of different outer diameter. The upper surface 26 is formed by the thicker upper portion of vertical segmented-arc arms 27 having axial spaces therebetween filled with elastomeric material 28.

The metal or rigid-material reinforcing structure 29 consists of a reduced diameter cylindrical base section 30 and the parallel, spaced-apart vertical arms 27. The lower portion 31 of each of arms 27 is relatively thin and of the same outer diameter as base section 30. An inner annular enlargement 32, cut from the inside of arms 27, adds to the flexibility of the arms.

Elastomeric material 28 is injection-molded into the inner bore of reinforcing structure 29 and fills the axial spaces between vertical arms 27. The material extends upward past the upper end of the arms to provide a flexible annular lip 33 at the top of the cup.

The different degrees of loading on a typical swab cup cause different areas of the cup to provide sealing contact with the conduit in which it is located. These different areas are denoted in FIG. 3 by arrows. A light load on the swab cup is carried by area L of the cup engaging the conduit inner wall. A moderate load pushes area M out into engagement with the conduit and effictively removes most of the load from area L. A heavy load moves the contact area down the section H and reduces most or all of the load on areas L and M. Thus, that portion of the cup where the greatest portion of per-unit-area of loading will occur is designed to contain the thickest wear areas.

Figure 5:
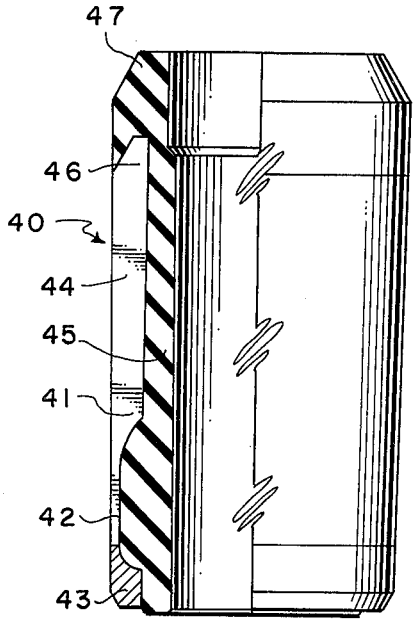

Another embodiment of the invention is illustrated in FIG. 5 wherein the swab cup 40 is formed as a tapered cylinder with a generally tapered cylindrical reinforcing structure 41. Structure 41 has a tapered cylindrical outer surface and a generally right-cylindrical inner surface with an annular undercut 42 near the lower end thereof. A circular base portion 43 contains a number of upward extending spaced arms 44 with axial slots therebetween. An elastomeric material 45 is bonded to the inside of structure 41 and in the axial slots between arms 44.

The reduced thickness of section 42 provides the requisite flexibility of the cup and the thicker sections 46 provide the long wearing ability of cup. An annular upper lip 47 is formed of the elastomeric material for light loads on the swab as mentioned above with respect to FIG. 3.

Figure 6:
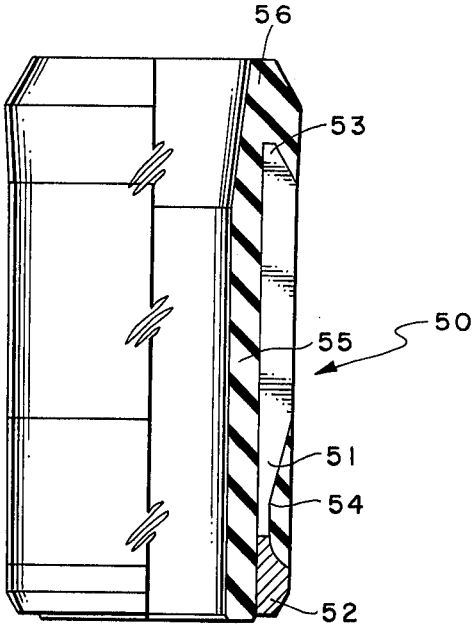

Yet another embodiment of the invention is disclosed in FIG. 6 which illustrates a swab cup 50 with a generally cylindrical hard-material reinforcing structure 51. Structure 51 has a closed cylindrical base section 52 with a plurality of arc-segmented, upward extending arms 53 formed thereon.

The structure of cup 50 is generally the same as that of cup 40 except that the flex area 54 formed by an external undercut is in the reinforcing structure. Also, base section 52 has a slightly smaller OD that that of arms 53.

Elastomeric material 55 is injection-molded to the inside of structure 50 and fills the spaces between arms 53 as well as the annular undercup 54. An upper lip 56 is also formed of the elastomeric material to provide light-load sealing.

Thus, several embodiments of improved swab cups have been disclosed which provide greater wearing ability in the conduit. The provision of a thick wear area with a thin flex area provides optimal swab cup characteristics. This feature is extremely important to the operator because it greatly reduces the chances of swab cup failure and loss of metal pieces into the wellbore which could damage other tools therein.

Also, the provision of a curvilinear outer surface on the swab cup reinforcing structure, which surface is substantially of the same arc and diameter as the inside of the swabbed conduit, means that swab cup requires no initial wearing or "seating" in to provide full sealing contact in the conduit. Prior art devices utilize wire reinforcing material or flat reinforcement arms which initially have small surface area contact resulting in high surface loading and resultant fast wear on the structure.

Although certain preferred embodiments of the present invention have been herein described in order to provide an understanding of the general principles of the invention, it will be appreciated that various changes and innovations can be effected in the described swab cup design without departing from these principles. For instance, the present invention has been described as structure for use as a swab cup but it would be possible to utilize identical or similar structure on a larger scale, on a packer mandrel for use as a well packer in a wellbore. Also, whereas the reinforcing structure has been disclosed as made of a metal, it is clear that other materials such as plastics could be used. All modifications and changes are deemed to be embraced by the spirit and scope of the invention except as the same may be necessarily limited by the appended claims or reasonable equivalents thereof.

The embodiments of the invention in which an exclusive property or privilege is claimed are defined as follows:

1. Annular sealing apparatus for use in tubular conduit, said apparatus comprising:

a generally cylindrical outer reinforcing structure formed of a relatively hard material, having a circular base, a plurality of spaced apart arms extending upward from said base, a thin flex area in said arms near said base, and a thick wear section above said flex section in each said arm; and, a resilient annular sealing element inside of and attached to said reinforcing structure, having an axial bore opening therethrough, and extending upward at least as far as the upper ends of said arms.

2. The sealing apparatus of claim 1 wherein said arms each have an upper angular taper and said resilient element fills the spaces between said arms.

3. The sealing apparatus of claim 1 wherein said arms each have a cross-sectional configuration that is generally a segmented, cylindrical concentric arc.

4. The sealing apparatus of claim 2 wherein said arms each have an inner ribbed section which gives said arms a generally T-shaped cross-sectional configuration.

5. An oil well swab cup for use in a well conduit on a cylindrical member; said swab cup comprising:

an outer reinforcing structure made of a relatively hard flexible material, said structure further comprising a circular base with a plurality of spaced apart arms extending axially upward therefrom; said arms each having a narrow flexible lower section and a relatively thick, ribbed upper section, with said upper section having a generally T-shaped cross-sectional configuration; and, an elastomeric sealing element securely held inside said reinforcing structure and protruding between said arms, said element having an axial bore therethrough.

6. The swab cup of claim 5 wherein said spaced arms each have an upper angular taper forming a peripheral lip around said swab cup.

7. The swab cup of claim 5 wherein said arms each have a curvilinear cross-sectional configuration.

8. A reinforcing structure for use in an elastomeric sealing cup apparatus, said structure comprising:

a generally cylindrical reinforcing sleeve formed of a relatively hard flexible material and having:

a generally cylindrical base section;

a plurality of spaced apart arms connected to and extending upward from said base section;

a thick wear portion on each of said arms; and, a thin flex portion on each of said arms near said base section.

9. The reinforcing structure of claim 8 wherein each of said spaced apart arms has a curved outer surface adapted for sealing engagement with a conduit inner wall.

10. The reinforcing structure of claim 8 wherein said sleeve has a generally cylindrical outer surface with an outer diameter approximately equal to the inner diameter of a conduit in which it is arranged to seal.

11. The reinforcing structure of claim 8 wherein said sleeve comprises a section of cylindrical tubing having a plurality of spaced longitudinal slots therethrough and along a portion of the length thereof, and said flex portion comprises an undercut annular portion in said tubing.

12. The reinforcing structure of claim 8 wherein said sleeve has a constant taper from a point near one end to a point near the opposite end.

13. The reinforcing structure of claim 8 wherein said sleeve has two different cylindrical outer diameters.

* * * * *